US005092791A

United States Patent [19]

Contarino

[11] Patent Number: 5,092,791

[45] Date of Patent: Mar. 3, 1992

[54] BULKHEAD FEEDTHROUGH ADAPTOR FOR IEEEE-488 CABLES

[75] Inventor: Alfred F. Contarino, North Andover, Mass.

[73] Assignee: L-COM, Inc., N. Andover, Mass.

[21] Appl. No.: 644,675

[22] Filed: Jan. 22, 1991

Related U.S. Application Data

[63] Continuation of Ser. No. 442,112, Nov. 28, 1989, abandoned.

[51] Int. Cl.[5] ..... H01R 13/621

[52] U.S. Cl. ..... 439/365; 439/654; 439/564

[58] Field of Search ..... 439/365, 562, 653, 654, 439/362-364, 368, 542, 564, 573

[56] References Cited

U.S. PATENT DOCUMENTS

| | | | |
|---|---|---|---|
| 3,082,398 | 3/1963 | Valach | 439/362 |
| 4,243,289 | 1/1981 | Kozel | 439/562 |
| 4,398,780 | 8/1983 | Novotry et al. | 439/362 |
| 4,592,614 | 6/1986 | Myers, Jr. | 439/654 |
| 4,781,625 | 11/1988 | Yang | 439/654 |

FOREIGN PATENT DOCUMENTS

| | | | |
|---|---|---|---|
| 1445657 | 6/1966 | France | 439/365 |

OTHER PUBLICATIONS

L-Com Product Literature.

*Primary Examiner*—Gary F. Paumen

*Attorney, Agent, or Firm*—Greenfield & Sacks

[57] ABSTRACT

An adaptor for interconnecting two or more IEEE-488 cables, each cable terminating in a connector having a male fitting. The adaptor includes a housing defining first and second ports which are disposed on opposite sides of the housing, and a pair of first and second electrically connected female fittings. The first female fitting is disposed in the first port and the second female fitting is disposed in the second port to enable the two IEEE-488 cables to be interconnected using the male fittings while leaving exposed their corresponding female fittings.

12 Claims, 4 Drawing Sheets

BULKHEAD FEEDTHROUGH DAPTOR FOR IEEEE-488 CABLES

This application is a continuation of application Ser. No. 442,112, filed Nov. 28, 1989, now abandoned.

FIELD OF INVENTION

This invention relates to an adaptor for joining together the male fittings of two or more IEEE 488 standard electrical cables.

BACKGROUND OF THE INVENTION

IEEE-488 cables are used to interconnect programmable measurement and instrumentation devices to form an integrated system. These cables are carefully shielded to minimize interference between signal lines and reduce susceptibility to external noise, and to minimize transmission of signals to the external environment. Each cable terminates in a right angle connector having a standardized male fitting on one side and a standardized female fitting on the opposite side of the connector. These fittings are designed to enable "piggy backing" of a series of cables as described in more detail below.

The IEEE-488 cables are often used in circumstances where there are obstructions in the path of the cable. For example, a panel of a console may physically block the path of the cable. One commercially available adaptor which is designed to interconnect two IEEE-488 cables through a panel is bulkhead adaptor model number CIB24BA available from L-Com, Inc. of North Andover, Mass. The CIB24BA bulkhead adaptor contains a female fitting on one side and a male fitting on the opposite side.

Two or more IEEE-488 cables can be joined together by inserting the male fitting of the connector of a first cable into the female fitting of the connector of a second cable. Two hold down screws, one on each side of the female fitting, enable the male fitting of the first cable to be securely attached to the female fitting of the second cable. Frequently, it is desired to "piggyback" more than two IEEE-488 cables. Piggybacking refers to coupling more than two cables at a single junction. However, since the female cable fitting of the second cable must be used to connect with the male fitting of the first cable, no additional cables with female connectors can be "piggybacked" to the second cable. This is a significant drawback when the connector of the first cable is mounted on a panel of a console such that its female fitting is not accessible on the outside of the console.

Additionally, cables are traditionally connected so that the cable portions which extend from the connectors approach and leave the bulkhead adaptor from the same direction. For example, a cable approaches from right to left, terminates in a connector which is mated to one fitting of the adaptor, and the cable on the other side of the adaptor then extends away from the adaptor back toward the right on the other side of the panel. This arrangement is awkward if the second cable communicates with equipment which is located toward the left of the adaptor.

SUMMARY OF THE INVENTION

The adaptor of the invention accepts the male fitting of two IEEE-488 cables to electrically interconnect them. The adaptor includes a housing which defines first and second ports, the first and second ports being disposed on opposing sides of the housing. A first female fitting is disposed in the first port and a second female fitting is disposed in the second port, and the pair of female fittings are electrically interconnected.

In a preferred embodiment, the housing is formed of two casings which are secured together by interconnection means such as metal screws. Each female fitting contains a number of pins arranged in sequential order in two rows, and a wire extends from a pin of one female fitting to the corresponding pin on the other fitting. An electrically insulative spacer underlies the interconnecting wires on at least one side. A pair of hold-down screw fittings are provided on either side of each female fitting.

A mounting bracket may be provided for use of the adaptor as a bulkhead adaptor. In a preferred construction, the housing is formed of two casings secured back to back with the mounting bracket secured between them.

In one embodiment, the female fittings are oriented such that, for first and second IEEE cables which are interconnected by the adaptor, the first cable extends from one side of the adaptor and the second cable extends away from the other side of the adaptor.

It is among the objects of the invention to provide a new adaptor which accepts the male fittings of two IEEE cables.

It is a further object of the invention to define such an adaptor which may be mounted to a panel to accept the male fittings of the cables while leaving the female fittings of the cables exposed to enable piggybacking of additional cables.

Yet another object of the invention is to provide such an adaptor which may reverse the direction of the cables to provide an in line cable system.

DETAILED DESCRIPTION OF THE DRAWINGS

Figure 1:
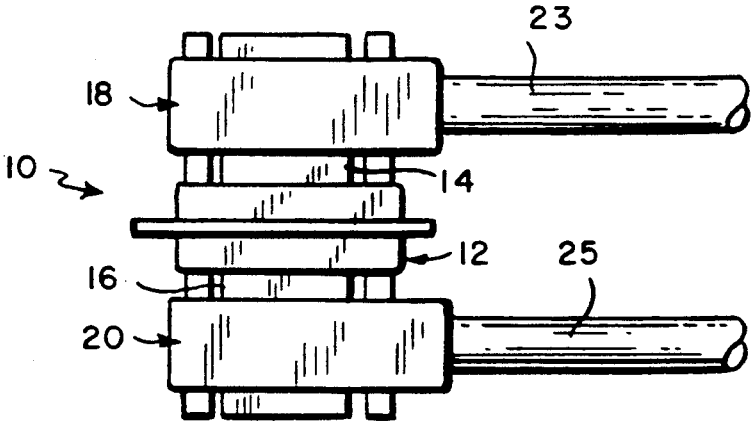
FIG. 1 is a schematic top-plan view of two IEEE-488 cables interconnected by an adaptor according to the invention in a standard cable entry configuration.

The invention may be accomplished by an adaptor which joins together two or more IEEE-488 cables by accepting the male fitting of the end connector of each cable. The adaptor is formed of a housing having first and second ports disposed on opposite sides of the housing, and first and second female fittings which are disposed in the first and second ports, respectively. The female fittings are electrically interconnected. The term "male fitting" refers to a plug which is insertable into a receptacle or jack, whereas the term "female fitting" refers to a receptacle or jack which receives the male fitting. An adaptor 10 according to the invention includes a housing 12 which defines ports 14 and 16, each containing female fittings which receive male fittings from connectors 18 and 20, respectively. Connectors 18 and 20 establish the terminal ends of IEEE-488 cables 23 and 25, respectively, which are shown in FIG. 1 as extending from and returning to the same direction. This configuration is an industry standard configuration.

Figure 2A:
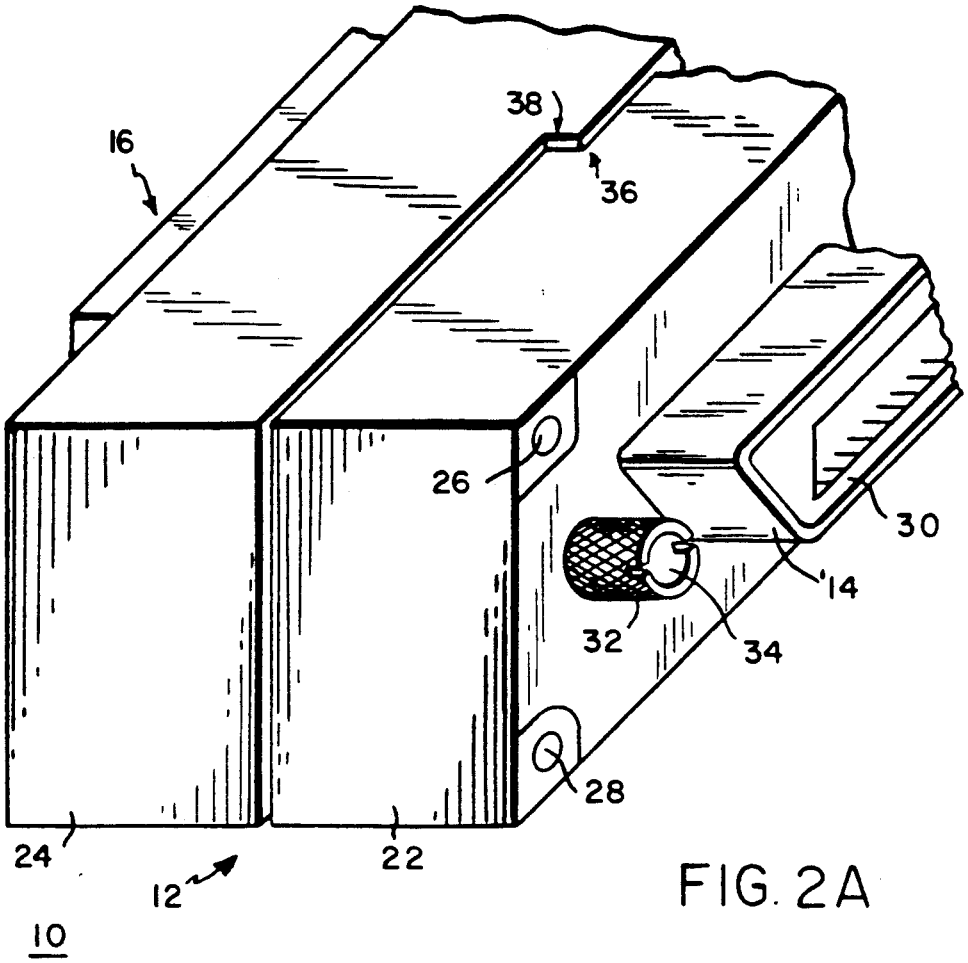
FIG. 2A is a schematic perspective partial view of an adaptor according to the invention with the bulkhead mounting plate removed.
Figure 2B:
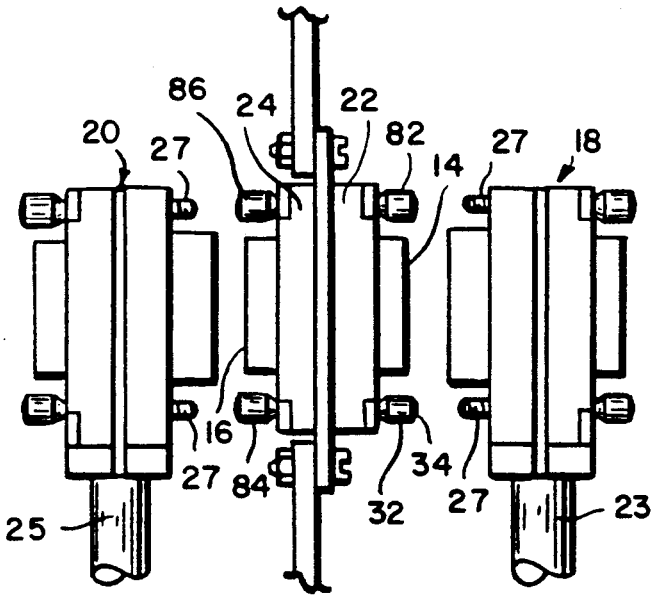
FIG. 2B is an exploded schematic top-plane view of two IEEE-488 cables prior to interconnection by the adaptor of FIGS. 1 and 2A.

The adaptor 10 is shown in greater detail in FIG. 2A and 2B. Housing 12 is formed of first and second casings 22 and 24. Casings 22 and 24 are secured together by screws which pass through corner openings such as openings 26, 28 defined in casing 22. Casing 22 further defines the port which contains a female fitting 30. The casing 22 further includes a hold-down screw receptacle 32 defining a threaded opening 34 which receives a matching screw 27 from the connector 18 in FIG. 2B. The casing 22 contains at least one indent 36 which matches an indent 38 of the casing 24 to assure proper assembly of the housing 12 and proper shielding integrity.

Figure 3A:
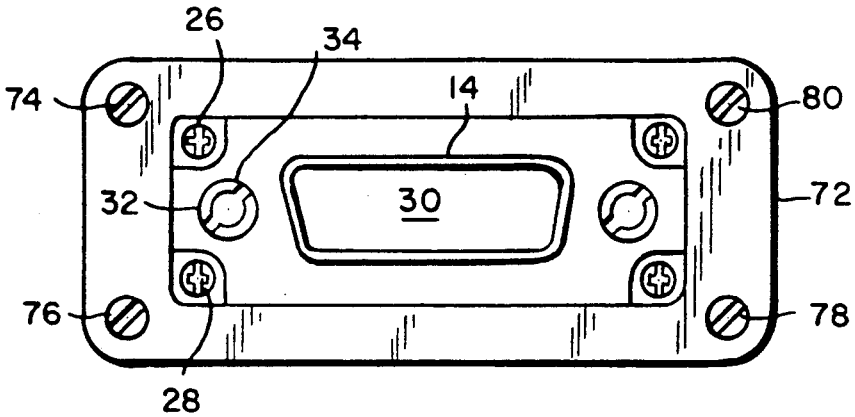
FIG. 3A is an elevational view of one side of the adaptor of FIG. 1.
Figure 3B:
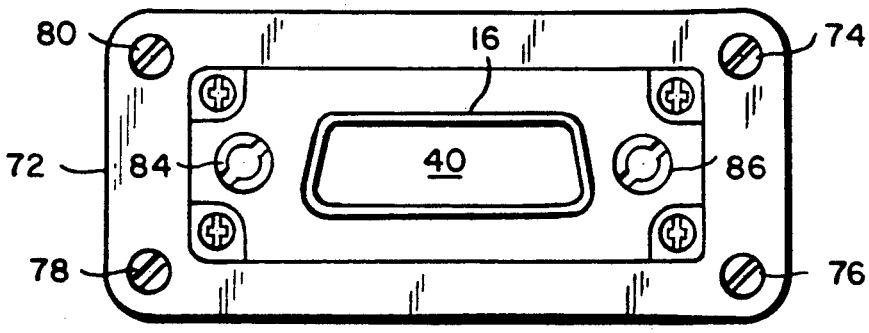
FIG. 3B is an elevational view of the opposing side of the adaptor of FIG. 1.

The ports 14 and 16 of casings 22 and 24 contain female fittings 30 and 40, respectively, as shown in elevational detail in FIGS. 3A and 3B. In this construction, female fittings 30 and 40 each contain twenty four electrical contacts which are arranged sequentially in two rows. In FIGS. 3A and 3B, the numerals 1 and 12 indicate the first and last pins of a first row, while numerals 13 and 24 indicate the first and last pins of the second row.

Figure 4:
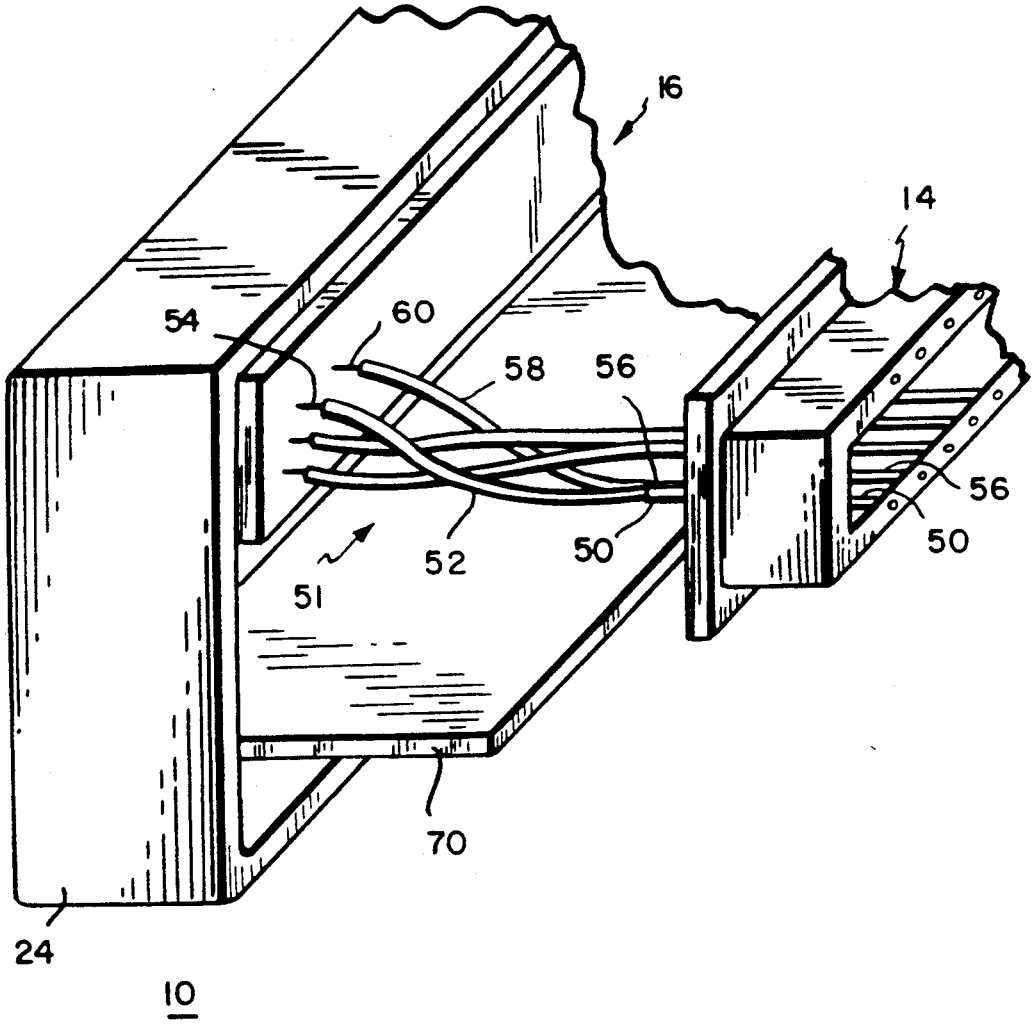
FIG. 4 is a schematic perspective exploded view of the adaptor of FIG. 1 with the mounting plate and one casing removed.

The relationship of the pins is shown in greater detail in FIG. 4 in which metal contact 50, corresponding to pin 24 of female fitting 14, is electrically connected by wire 52 to metal contact 54, corresponding to pin 24 of female fitting 16. Similarly, metal contact 56 of female fitting 14 is interconnected by wire 58 to corresponding contact 60 on female fitting 16. Metal contacts 56 and 60 each correspond to pin 23 on female fittings 14 and 16, respectively.

The adaptor 10 further includes an insulative spacer 70 made of a plastic such as Lucite which assists alignment of the wires 51 as casings 22 and 24 are compressed toward each other during assembly.

Mounting bracket 72, FIGS. 3A, 3B, is omitted from FIGS. 2 and 4 for clarity of illustration. Mounting bracket 72 enables the adaptor 10 to serve as a bulkhead adaptor in which screws are passed through openings 74, 76, 78 and 80, respectively, to secure the adaptor 10 to a panel.

In one construction, the casings 22, 24 are approximately 2.475 inches in length, 0.915 inches in height, and 0.54 inches in depth. The mounting plate 72 is approximately 3.25 inches in length, and 1.38 inches in height. A recommended opening of 2.50 inches by 0.93 inches enables one of the casings 22, 24 to be inserted through the opening and attached to the panel by mounting bracket 72. The mounting panel 72 is nickel plated steel, the casings 22, 24 are dye cast aluminum with clear chromate coating. The hold down screws 32, 82 of casing 22 and hold-down screws 84, 86 of casing 24 are preferably black anodized steel. The screws joining the casings are nickel plated steel. The contacts are plated with fifteen micro inch goldplate which is plated over nickel on a copper alloy base.

Figure 5:
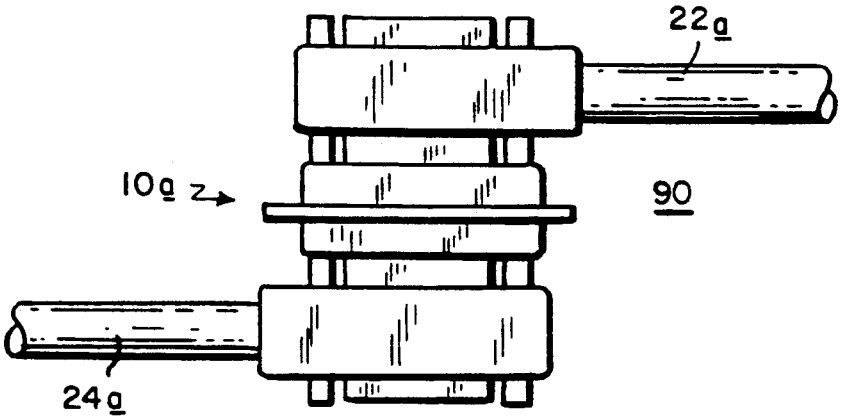
FIG. 5 is a schematic plan view of an alternative adaptor according to the invention having one of the female ports reversed to enable the cables to extend in opposite directions to form an in line cable system.
Figure 6A:
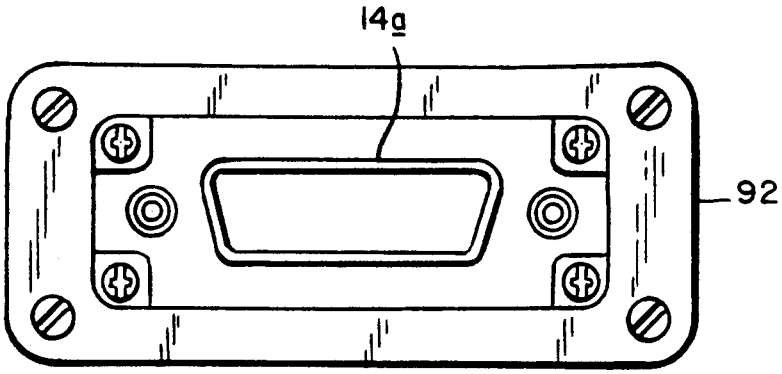
FIGS. 6A and 6B are elevational views of opposing sides of the adaptor of FIG. 5.
Figure 6B:
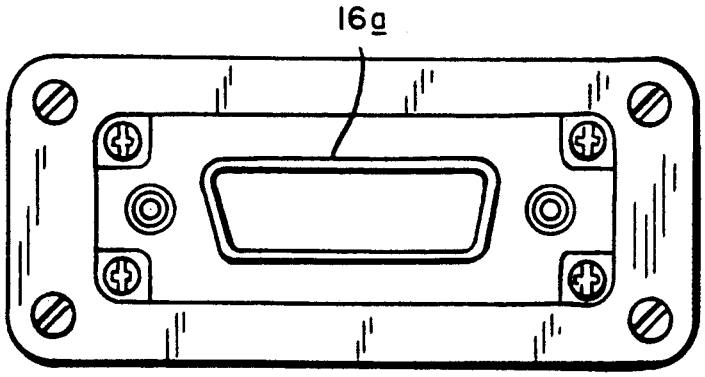

FIG. 5 shows an alternate embodiment of the invention. In FIG. 5, adaptor **10*a* discloses an in-line cable system 90 in which cable 22*a* extends from the right and cable 24*a* extends away to the left. This configuration is accomplished by the arrangement of female fittings 14*a* and 16*a* on adaptor 10*a* as shown in FIGS. 6A and 6B. In contrast to the first embodiment wherein female fitting 16 is upside down with respect to female fitting 14, in the second embodiment, female fitting 16A is arranged right side up with respect to female fitting 14A. The bridging wires which join respective pins 12 of fittings 14A and 16A, for instance, extend diagonally inside the housing 10*a* since they are at opposite ends of the housing 10*a*. In the first embodiment of the invention shown in FIGS. 3A and 3B, by contrast, respective pins 12 of fittings 14 and 16 are disposed at the same end of the housing 10. The adaptor 10*a* can be either provided with mounting bracket 92 for use with a bulkhead adaptor or can be used without mounting bracket 92. The embodiment of the invention illustrated by FIGS. 5, 6A and 6B** would be used where the overall cable routing scheme requires the cable to continue in the same direction.

Various changes and modifications to the embodiments shown in the drawings and described above may be made within the scope of the invention. Therefore, it is intended that all matter contained in the above description and shown in the accompanying drawings shall be interpreted in an illustrative and not limiting sense.

What is claimed is:

1. A bulkhead feedthrough adaptor for joining together at least first and second IEEE-488 cables disposed on opposite sides of a bulkhead, each cable terminating in a connector having a male and a female fitting, comprising:

a housing defining first and second ports, said first and second ports being disposed on opposing sides of said housing;

a first female fitting disposed in said first port;

a second female fitting disposed in said second port;

means for electrically interconnecting said first and second female fittings;

a mounting bracket attached to said housing for mounting said adaptor to said bulkhead; and at least a pair of hold-down screw fittings disposed on each said opposed side of the adaptor, each screw fitting for receiving a male screw of the corresponding IEEE-488 cable fitting.

2. The adaptor of claim 1 wherein said housing is formed of first and second casings which abut in a back-to-back relationship, said first casing defining said first port and said second casing defining said second port.

3. The adaptor of claim 1 wherein said first and second female fittings are standard IEEE-488 female fittings and are disposed in said ports such that said connectors of said at least two IEEE-488 cables are coupled to said first and second female fittings such that said first and second cables extend away from said adaptor in opposite directions.

4. The adaptor of claim 3 wherein said housing is formed of first and second casings which abut in a back-to-back relationship, said first casing defining said first port and said second casing defining said second port and further comprising a mounting bracket disposed between said first and second casings for mounting said adaptor to a panel.

5. The adaptor of claim 3 wherein said second female fitting is disposed on said housing right side up relative to said first female fitting.

6. A bulkhead feedthrough system for interconnecting two or more IEEE-488 cables disposed on opposite sides of a bulkhead, comprising:

a first IEEE-488 cable terminating in a connector having a male and a female fitting;

a second IEEE-488 cable terminating in a connector having a male and a female fitting;

an adaptor including:

a housing defining first and second ports, said first and second ports being disposed on opposing sides of said housing;

a first female fitting disposed in said first port;

a second female fitting disposed in said second port;

means for electrically interconnecting said first and second female fittings;

means for mounting said adaptor to said bulkhead; and at least a pair of hold-down screw fittings disposed on each said opposed side of the adaptor, each screw fitting for receiving a male screw of the corresponding IEEE-488 cable fitting.

7. The adaptor of claim 6 wherein said housing is formed of first and second casings which abut in back-to-back relationship, said first casing defining said first port and said second casing defining said second port.

8. The adaptor of claim 7 wherein said means for mounting said adaptor to said bulkhead comprises a mounting bracket disposed between said first and second casings.

9. The adaptor of claim 2 wherein said hold-down screw fittings comprise a screw receptacle defining a threaded opening for threadedly receiving said male screw.

10. The adaptor of claim 7 wherein said hold-down screw fittings comprise a screw receptacle defining a threaded opening for threadedly receiving said male screw.

11. The adaptor of claim 2 wherein said first and second casings further comprise matching indents whereby the casings can be assembled in only one relative orientation.

12. The adaptor of claim 7 wherein said first and second casings further comprise matching indents whereby the casings can be assembled in only one relative orientation.

* * * * *